United States Patent [19]

Kerti et al.

[11] 3,969,207

[45] July 13, 1976

[54] METHOD FOR THE CYCLIC ELECTROCHEMICAL PROCESSING OF SULFURIC ACID-CONTAINING PICKLE WASTE LIQUORS

[75] Inventors: József Kerti; Andor Mándoki, both of Budapest; Miklós Széky, Salgotarjan, all of Hungary

[73] Assignee: Licencia Találmányokat Értékesitó Vállalat, Budapest, Hungary

[22] Filed: Mar. 5, 1975

[21] Appl. No.: 555,430

[52] U.S. Cl. ..... 204/180 P; 204/93; 204/104; 204/112; 204/130; 204/151

[51] Int. Cl.[2] ..... C25F 7/02

[58] Field of Search ..... 204/180 P, 151, 130, 204/112, 93, 104

[56] References Cited

UNITED STATES PATENTS

| | | | |
|---|---|---|---|
| 984,703 | 2/1911 | Ramage | 204/112 |
| 1,007,388 | 10/1911 | Ramage | 204/112 |
| 1,375,631 | 4/1921 | Haglund | 204/112 |
| 1,397,562 | 11/1921 | Thatcher | 204/130 X |
| 1,954,664 | 4/1934 | Cain | 204/130 X |
| 2,865,823 | 12/1958 | Harris et al. | 204/151 |

*Primary Examiner*—John H. Mack
*Assistant Examiner*—A. C. Prescott
*Attorney, Agent, or Firm*—Karl F. Ross; Herbert Dubno

[57] ABSTRACT

The invention relates to a process for the cyclic electrochemical processing of pickle waste liquors containing a maximum 100 g. of sulfuric acid and a minimum of 25 g. of iron ions per liter, combined with the pickling of iron. According to the invention the ammonium, magnesium or alkali-metal sulfate concentration of the waste liquor is adjusted to 0.5–1.0 mol./l. by introducing an appropriate salt, and the acid content of the waste liquor is reduced to a value not exceeding 100 g. of sulfuric acid/liter, then the waste liquir is fed into and passed through the cathode chambers of an electrolysis apparatus consisting of a series of dual electrolytic cells with diaphragms, whereupon the iron content of the waste liquor is reduced to a value of 7–15 g. of $Fe^{2+}$/liter, thereafter the waste liquor is fed into and passed through the anode chambers of said electrolysis equipment in parallel with the cathode flow, and a current density of 15–22 A/dm². of diaphragm surface and an electrolysis temperature of 70°–90°C is maintained.

4 Claims, 1 Drawing Figure

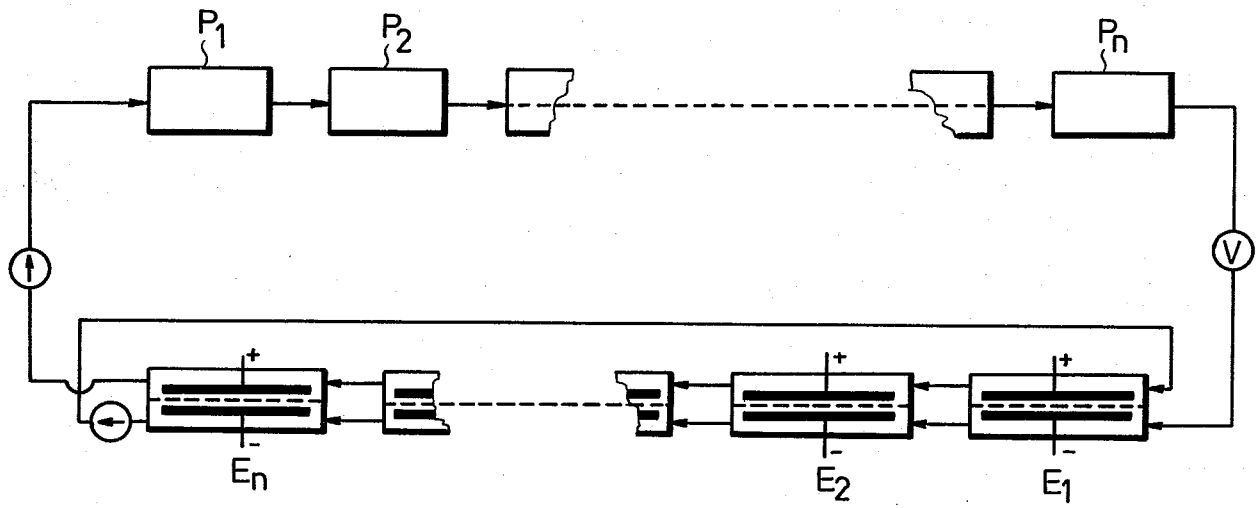
P1
P2
Pn
+
-
En
+
-
E2
+
-
E1

METHOD FOR THE CYCLIC ELECTROCHEMICAL PROCESSING OF SULFURIC ACID-CONTAINING PICKLE WASTE LIQUORS

This invention relates to a method for the cyclic electrochemical processing of sulfuric acid-containing pickle waste liquors.

As is known, when metallurgical semi-finished products, such as sheets, bands, wires or profiles, are descaled with sulfuric acid, iron sulfate enters into solution, which can be separated as ferrous sulfate heptahydrate ($FeSO_4.7H_2O$) upon cooling or by subjecting the waste liquor to vacuum treatment. Since the decrease in sulfuric acid content of the pickling solution also decreases the rate of pickling, the waste liquors, even those obtained after exhaustive pickling, always contain unconsumed acid. The acid content of the waste liquor is at least 20 to 30 g. of sulfuric acid per liter of solution, but, depending on the method of pickling, the residual concentration of the acid may reach or even exceed several hundred grams per liter. In order to increase the rate of pickling it is generally desirable to increase the acid concentration, and to avoid the exhaustion of the solution by almost total consumption of sulfuric acid. The productivity of pickling plants increases with the increase in the pickling rate.

The efforts to accelerate pickling are limited, however, by the fact that with increasing acidity of the waste liquor the amount of unconsumed acid leaving the system in the waste liquor is increased proportionally. This increases the operational costs and causes problems of environmental pollution, since disposal of acidic sewages is strictly prohibited by regulations. On the other hand, the difficulties and costs of neutralizing the waste liquors, usually performed with lime, also increase in parallel with the acid content of the waste liquor. It is a further disadvantage of the lime treatment that neutralization proceeds in a heterogeneous reaction, and thus complete neutralization cannot be achieved even with lime in excess. Moreover, the handling, transportation and disposal of lime sludge are difficult and expensive operations, providing no refunds (e.g., recovery of chemicals, etc.) at all.

An industrially acceptable method of processing sulfuric acid-containing waste liquors is the separation of ferrous sulfate heptahydrate by vacuum crystallization. The acidity of the waste liquor increases as a consequence of the withdrawal of water of crystallization and steam, thus the resulting solution can be re-introduced into the pickling procedure. Because the demand for ferrous sulfate heptahydrate is rather limited, the major part of the thus-obtained solid is discarded, so that the problems of environmental pollution cannot be overcome by this method either. Therefore the large-scale use of this method is very much restricted.

Thus, in the last two decades the attention of research workers has turned toward the development of a method by which the acid content of the waste liquors formed in pickling can be recovered, and iron sulfate can be reconverted simultaneously into sulfuric acid. These methods may be based for instance on the electrochemical decomposition of iron sulfate according to the equation $$FeSO_4 + H_2O \rightarrow Fe + H_2SO_4 + 0.5\ O_2$$

In this reaction an amount of iron equivalent with the amount of sulfuric acid regenerated separates on the cathode.

The above electrochemical reaction is, however, not easy to achieve, because the cathodic separation of iron from acidic media can be performed only with low efficiency, and furthermore, the separation of iron gradually ceases with the increasing acidity of the medium, due to the evolution of hydrogen on the cathode. Thus the electrolysis terminates in the electrochemical decomposition of water, while the ferrous sulfate present remains unchanged. The various methods developed so far aim, in this respect, essentially at suppressing the electrochemical decomposition of water.

According to the method of F. Aigner and G. Jangg (Berg und Hüttenmännische monatshefte 12–18 /1969/), a streaming mercury cathode is used to suppress the cathodic hydrogen evolution, on which the iron can also be deposited from an acidic solution in amalgamated form. Iron can be separated from the amalgam in a separate cell by anodic oxidation. When an acid-free medium is used in this latter step, iron can be separated even on a solid cathode. This method has, however, several disadvantages. Since the removal of iron involves two separate electrolytical operations, and the mercury electrode can be operated only in a horizontal arrangement utilizing solely the upper surface, the spacial requirement of the apparatus is extremely great, and the apparatus itself is very expensive. The high price of mercury and the substantial losses of mercury commonly occurring in procedures utilizing mercury cathodes further increase the operational costs. Even the authors admit that the economy of the procedure is questionable, and the specific energy requirement of the process is about 12.5 to 13.5 *k*Wh/kg of iron. All the other procedures utilizing mercury cathodes involve similar disadvantages. In this respect reference is made to the review of A. T. Kuhn ("A Review of the Role of Electrolysis in the Treatment of Iron Pickle Liquors," Iron and Steel, June 1971, p. 173–176), which gives a general survey of the state of art and an objective comparison of the available methods.

Methods based on the use of permselective membranes have also been widely investigated. In these methods essentially an ion exchange membrane separates the anode and cathode chambers in order to prevent the migration of the hydronium ($H_3O^+$) ions towards the cathode. Despite the favorable results obtained in laboratory experiments, these procedures have not become widespread, primarily because of the great electric resistance, sensitivity towards heat, acids and mechanical effects, and the short life-span of the membranes. In this respect reference is made, beside Kuhn's review cited above, to the papers of Tamura and Ishino ("Treatment of Iron Containing Spent Sulfuric Acid by Electrolytic Dialysis" /Kogyo Kagaku Zasshi 69, 1435 /1966/; "Separation of Iron spent Sulfuric Acid by the Ion Exchange Resins" /ibid./).

According to a further method a bipolar active lead electrode is used in the separation of iron. In this method lead sulfate is formed anodically in an aqueous iron sulfate solution, simultaneously with the cathodic separation of iron, and, in a separate cell, lead and sulfuric acid are formed by the anodic reduction of lead sulfate. It is, however, a pre-condition of the applicability of this method that the iron sulfate solution fed into the electrolysis cell is neutral, thus this method cannot be applied for the direct processing of acidic pickle waste liquors, which can be processed by this method only after the previous crystallization and subsequent dissolution of ferrous sulfate heptahydrate (U.S. Pat. No. 3,111,468, British patent specification No. 992,584).

The same restriction applies to the composition of the pickle waste liquor processed according to the method of the Hungarian patent specification No. 156,806. According to this latter method the anode and cathode chambers are separated with a diaphragm, and an amount of sulfate ions exceeding the number of moles of sulfuric acid is provided in the anode chamber, preferably by adding an alkali sulfate or ammonium sulfate. The excess of sulfate ions suppresses the second dissociation step of the resulting sulfuric acid to such an extent that the majority of the protons of sulfuric acid are present in the form of $HSO_4^-$ anions, which, owing to the negative charge, do not migrate across the diaphragm into the cathode chamber. The pickle waste liquor is introduced into the cathode chamber. This process can be carried out, however, only with pickle waste liquors which contain no sulfuric acid. When sulfuric acid-containing pickle waste liquors are to be processed, according to the wording of the specification "the salt should be removed previously from the waste liquor by methods known per se, such as crystallization or thermal decomposition, and then it should be introduced into the catholite."

Now it has been found that the electrochemical decomposition of iron sulfate can be combined in an advantageous manner with the separation of the sulfate salt and acid content of the pickle waste liquor by a process in which the ammonium, magnesium or alkali metal sulfate concentration of the waste liquor is adjusted to 0.5–0.4–1.0 mole./liter by introducing an appropriate salt, and the acid content of the waste liquor is reduced to a value not exceeding 100 g. of sulfuric acid per liter, then the waste liquor is fed into the cathode chamber of an electrolysis equipment consisting of dual electrolytic cells with diaphragms, serially connected to each other, and is passed through the cathode chambers, whereupon the iron content of the waste liquor is reduced to 7–15 g. $Fe^{2+}$/liter, thereafter the waste liquor is fed into the anode chamber of the electrolysis unit, and is passed through the anode chambers in parallel to the flow in the cathode chambers, and a current density of 15–22 A/dm$^2$. of diaphragm surface and an electrolysis temperature of 70°–90°C is maintained by the proper adjustment of the voltage and the flow rate of the cooling water. This continuous operation ensures a gradual and advantageous concentration distribution of iron sulfate and bisulfate-forming additive in the steady-state equilibrium of the pickling-regenerating system, and thus cyclically repeating transport processes and electrochemical ion-exchange processes of favorable effect can be ensured through the diaphragm. This electrochemical ion exchange makes the use of permselective diaphragms unnecessary. As the diaphragm, preferably a dense polyester or polypropylene web is used, since these materials have good resistance to acid and thermo-mechanical effects, having therefore long useful life, and the costs of such webs are quite low in comparison with the other operational costs.

Thus the present invention relates to a process for the cyclic electrochemical processing of pickle waste liquors containing a maximum 100 g. of sulfuric acid and a minimum of 25 g. of iron ions per liter, combined with the pickling of iron, by the electrochemical decomposition of iron sulfate and the electrodialytic separation of the acid and sulfate salt components of the pickle waste liquor. According to the invention one proceeds as follows: the ammonium, magnesium or alkali metal sulfate concentration of the waste liquor is adjusted to 0.5–1.0 mol./liter by introducing an appropriate salt, and the acid content of the waste liquor is reduced to a value not exceeding 100 g. of sulfuric acid/liter, then the waste liquor is fed into and passed through the cathode chambers of an electrolysis apparatus consisting of a series of dual electrolytic cells with diaphragms, whereupon the iron content of the waste liquor is reduced to a value of 7–15 g. of $Fe^{2+}$ per liter, thereafter the waste liquor is fed into and passed through the anode chambers of the electrolysis apparatus in parallel to the cathode flow, and a current density of 15–22 A/dm$^2$. of diaphragm surface and an electrolysis temperature of 70°–90°C is maintained.

Thus the major advantage of the process according to the invention resides in that the exhaustion of the acidity of the waste liquor or the crystallization of the iron sulfate heptahydrate can be avoided. Thus the pickling - regeneration cycle can be performed directly even when the pickle waste liquor contains sulfuric acid, provided that the sulfuric acid content does not exceed 100 g./liter (i.e., about 1 mole/liter).

A block diagram of an apparatus for performing the above process is shown in the sole FIGURE of the drawing.

The acid concentration of the pickle liquor passed through steepers $P_1$, $P_2$ . . . $P_n$ decreases stepwise, and the iron concentration increases as a consequence of the chemical reaction occurring during pickling. The concentration of the bisulfate-producing additive (ammonium, magnesium or alkali metal sulfate) remains constant within the series of steepers. The pickle waste liquor is fed at a constant rate into the cathode chamber of electrolysis cell $E_1$, from which it is passed through the cathode chambers of electrolysis cells $E_2$, $E_3$ . . . $E_n$. Iron separates on the cathode; this cathode process is optionally accompanied with hydrogen evolution depending on the acidity of the catholyte. The other part of the acid content of the waste liquor passes the diaphragm and enters the anode chamber in the form of $HSO_4^-$ anions. Simultaneously, the cations of the added sulfate salt migrate from the anode chamber into the cathode chamber through the diaphragm. As a consequence, the iron and acid concentrations of the solution decrease, whereas the concentration of the bisulfate-producing additive increases from cell to cell while passing the cathode chamber. Thus essentially the acid content of the waste liquor passes into the anode chamber through the diaphragm by ion transport (electrodialysis), and simultaneously the iron sulfate present in the catholite is replaced by ammonium, magnesium or alkali metal sulfate as a result of the ion transport processes and metal deposition. The solution leaving the cathode chamber of the last cell $E_n$, i.e., the final catholyte is practically acid-free (pH = 1.6 to 2.0), its residual iron concentration is 10 g. of $Fe^{2+}$ /liter, and its sulfate salt concentration is about 1.5 mol./liter.

The final catholyte is reintroduced to the beginning of the cell series with a pump. The solution is otherwise passed by a stepwise sloping arrangement of the individual cells, where the overflowing liquor is fed into the next cell. The pump introduces the solution into the anode chamber of cell $E_1$, wherefrom the solution passes the anode chambers of cells $E_2$, $E_3$ . . . $E_n$, respectively. In this process the acid content of the solution increases, and the concentration of the bisulfate-producing salt decreases from cell to cell. The gradual increase in the acid content is partly a result of anodic acidification, and partly of the iron transport discussed above (infiltration of $HSO_4^-$ anions), whereas the decrease of the salt concentration can be attributed to the migration of the salt-forming cations into the cathode chamber through the diaphragm.

The acid content of the final anolyte can be calculated by the formula $$C_{reg} = C_p + 1.75\ Fe^{2+}{}_{max} - Fe^{2+}{}_{min}$$

wherein

C reg is the acid content of the final anolyte (g./l.), $C_p$ is the acid content of the pickle waste liquor (g./l.), $Fe^{2+}{}_{max}$ is the iron content of the pickle waste liquor (g./l.), $Fe_{min}{}^{2+}$ is the iron content of the final catholyte (g./l.), and the co-efficient 1.75 is the weight ratio of equivalent amounts of sulfuric acid and iron.

The bisulfate salt content of the final anolite is necessarily the same as that of the pickle waste liquor, since in steady state equal amounts of salt enter and leave the electrolysis apparatus during unit time. Thus the bisulfate-producing salt promotes the electrochemical ion exchange in accordance with the above mechanism, but does not take part in the electrode processes.

The operational parameters should be maintained within the intervals given above, since otherwise the gradual change of concentrations cannot be ensured or maintained, respectively, within the operation cycle, and thus the electrochemical decomposition of iron sulfate accompanied with the separation of iron sulfate and residual acid could not be performed. If the concentration of the bisulfate-producing salt is lower than 0.5 mol./liter in the pickle liquor, the amount of the salt is insufficient to catalyze the electrochemical ion exchange process, whereas if it exceeds 1.0 mole/liter, the pickling rate and the water-solubility of iron sulfate decrease to a considerable extent. When the residual sulfuric acid content of the pickle waste liquor is much higher than 100 g./liter, the current efficiency decreases, and the specific energy required for regeneration increases considerably. Without the use of diaphragm, anolite and catholite are quickly mixed with each other by the evolved gas, and the electrochemical ion exchange becomes impossible. When one attempts to exhaust completely the iron content of the solution by cathodic metal deposition, the efficiency of electrolysis decreases, and there is an increasing risk of turning the catholyte alkaline. When in the final catholite the amount of iron exceeds 15 g./l., the anodic oxidation of $Fe^{2+}$ into $Fe^{3+}$ may lead to the decrease of efficiency and furthermore to the increase of pickling losses. If the flows of the catholyte and anolyte are not parallel, the ion exchange mechanism discussed above would be completely upset, and neither the electrodialytic separation of the residual acid nor the electrochemical decomposition of iron sulfate could be carried out with acceptable efficiencies. At current densities lower than 15 A/dm². the productivity of the equipment is insufficient, and the ion transport cannot overbalance the diffusion through the diaphragm, which also results in a decrease of efficiency. At a current density higher than 22 A/dm². the structure of the cathode deposit will be inappropriate, which would lead to operational difficulties. The transport number of ions taking part in the conduction of current depends on the temperature, and in the given system the transport numbers become favorable with respect to the ion exchange mechanism only at a temperature above 70°C. If the temperature exceeds 90°C, the undesirable foaming of the solution causes operational difficulties. The operation must be continuous, since the set-in of the steady-state gradual concentration distribution requires several hours, and during this initial period the efficiency of the operation cycle is lower. Thus the interruption of electrolysis always causes considerable time losses and decrease in productivity.

From the aspects of regeneration, the iron concentration of the pickle waste liquor can be maintained at any value. Taking into consideration, however, that the pickling rate decreases when the iron content of the pickle liquor exceeds 90 g. of $Fe^{2+}$/l., the iron content of the waste liquor is preferably maintained below this value. It must also be taken into account that with pickle liquors more rich in iron the risk of operational faults owing to heptahydrate deposition would also be higher.

The flow rate of the solution can be adjusted, e.g., on the basis of the following relationship, wherein the gradual change of concentrations has also been taken into account:

$$V = \frac{1.83 \times (Y \times n \times I)}{100\ (C_{reg} - C_p)}$$

In the above formula $V$ is the flow rate of the solution in the whole system in liter/hour, $Y$ is the percentage current efficiency, $n$ is the number of electrolysis cells serially connected with each other, $I$ is the current intensity (in A), and the other symbols have the same meanings as defined above. Coefficient 1.83 corresponds to the amount of sulfuric acid produced by a charge of 1 A x hour at a current efficiency of 100 %.

The value of $Y$, i.e., the percentage current efficiency depends primarily on the acid content of the pickle waste liquor. Under the operational conditions given above the percentage current efficiency and the specific energy requirement (A) related to unit weight of iron depend on the composition of the pickle waste liquor as given in Table 1.

Table 1

| Concentration (g./l.) of $Fe^{2+}$ | $(NH_4)_2SO_4$ | $H_2SO_4$ | Y % | A (kWh) |
|---|---|---|---|---|
| 80 | 80 | 100 | 52 | 7.8/kg. of Fe + 3 kg. of $H_2SO_4$ |
| 80 | 80 | 75 | 64 | 6.3/kg. of Fe+2.7 kg. of $H_2SO_4$ |
| 80 | 80 | 50 | 72 | 5.6/kg. of Fe+2.4 kg. of $H_2SO_4$ |

On the basis of the practical aspects discussed above, the sulfuric acid content of the pickle waste liquor is maintained between 50 and 100 g./l. The current efficiencies and specific energy requirements in this concentration range can be determined with appropriate security by interpolation from the data of the Table.

The data of Table 1 indicate that the ratio of the produced sulfuric acid and iron increases with the increase of the specific energy requirement. This is due to the fact that the electrolytic process is parallel with the electrodialytic separation of the residual acid and ferrosulfate. The acidity of the final anolyte increases, in fact, with the increase in the acid content of the pickle waste liquor, but at the same time the efficiency decreases, involving the increase of the specific energy requirement.

A further feature characterizing the appropriateness of the flow rate may be the composition of the final catholite, which may contain 7 to 15 g./l. of iron, and may have a pH of about 1.6 to 2.0. The flow rate can be controlled and/or checked, or the procedure can be automated in a manner known per se, on the basis of these data.

The nature of the cation of the bisulfate-producing additive has no effect on the efficiency of the procedure, provided that the molar amount of the additive is within the range given above. On the other hand, the cation of the additive plays an important role in the structure of the iron deposit on the cathode.

When ammonium or magnesium sulfate or their mixtures are used, a smooth, laminar deposit is formed on the cathode. Thus if a ballable product is to be obtained, ammonium and/or magnesium sulfate should be used as additive. In such instances the thickened cathode sheet is occasionally removed and replaced by a new iron sheet, and the removed cathode is processed by melting procedures, e.g., alloyed.

With potassium or sodium sulfate or their mixtures a coherent but less shiney deposit is formed on the cathodes of the first cells, while on the cathodes of the last cells, where the iron content of the catholite drops below 25 g.l. of $Fe^{2+}$ and the amount of additive already exceeds 1 mole/l., powdery iron deposits form on the surface of the cathode. With regard to the considerable demand for iron powder and also to the fact that iron powder is prepared from pickle waste liquors and for preventing environmental pollution, this method is very advantageous.

Thus when iron powder is to be prepared according to the invention, sodium and/or potassium sulfate is added as bisulfate-producing additive to the pickle liquor in an amount of 0.5 to 1.0 mol./liter, and an aluminum, graphite or lead cathode is used in the cathode chambers in which the iron concentration of the catholyte is less than 25 g. of $Fe^{2+}$/liter, in order to facilitate the removal of iron powder. With iron as cathode, the powdery particles are strongly adhered to the cathode sheet, whereas from aluminum, graphite or lead they can simply be swept off.

If the total iron content of the pickle waste liquor is to be separated in the form of iron powder, the electrochemical procedure can be combined only with pickling procedures that provide a waste liquor containing at most 25 g./l. of $Fe^{2+}$ and 20 g./l. of acid. Such conditions can be met by using open-steeper systems.

The apparatus for performing the process according to the invention consists of dual-chamber cells serially connected with each other in stepwise arrangement. The anode and cathode chambers are arranged alternately in the individual cells, and they are separated from each other by a diaphragm. The material of the diaphragm is preferably a thick-woven polyester or polypropylene web. The anode and cathode chambers of the individual cells are connected with each other through openings in the cell walls, thereby ensuring the independent flow of the catholyte and anolyte. An overflow level regulator is built into the anode and cathode chambers of the cells, respectively, in order to forward the liquor into the anode or cathode chamber of the next cell. Within one cell the anodes and cathodes are connected in parallel, but independently of each other, to the current-conducting collector bars, thus each of the cathodes can be removed from the system independently of the others. When, as discussed above, iron powder is to be prepared according to the process of the invention, iron sheets are used as cathodes in the first cells, whereas aluminum, lead or graphite cathodes are used in the cells wherein the concentration of the $Fe^{2+}$ ions is not more than 25 g./l.

The invention is elucidated in detail by the aid of the following non-limiting Examples.

Example 1

Open-steeper pickling of steel pipes to be zinc-plated, combined with electrochemical recovery of sulfuric acid.

Pickling takes place in four open steepers with serially connected flow, in a sulfuric acid solution at 70°C. In the steady-state equilibrium of the cyclic procedure the following steady concentrations prevail in the steepers:

| No. of steeper | $H_2SO_4$ g./l. | $Fe^{2+}$ g./l. | $(NH_4)_2SO_4$ g./l. |
|---|---|---|---|
| 1 | 262.5 | 30 | 80 |
| 2 | 195.0 | 50 | 80 |
| 3 | 127.5 | 70 | 80 |
| 4 | 60.0 | 90 | 80 |

The pickle waste liquor leaving the fourth steeper is fed in a continuous stream into the cathode chambers of the electrolyzing cell series. Upon passing the cathode chambers the iron content of the solution deposits onto the iron sheets immersed into the cathode chambers, and the pH of the solution rises to 1.8, while its iron content drops to 12 g./l., and its ammonium sulfate content increases to 165 g./l. The anode chambers are separated from the cathode chambers by stretched polypropylene web diaphragms. The cells are made of textile-reinforced resin profiles, with rubber sealing. The anodes are made of semi-hard lead sheets containing 1 % of silver. The final catholyte is pumped back to the first cell of the series, introduced into the anode chamber of the first cell, and then passed through the anode chambers of the consecutive cells. In this process the acid content of the solution rises to 294 g./l., while its ammonium sulfate content decreases to 80 g./l. The electrolysis is performed at a current density of 18 A/dm$^2$., and the temperature is maintained in the electrolyzing cells at about 85°C by controlling the flow rate of the cooling water. In order to supplement the sulfate losses due to evaporation and discharge, sulfuric acid is added to the final anolyte in an amount sufficient to adjust its sulfuric acid content to 330 g./l. Thereafter the recovered acid is fed again into the first steeper, and the cycle is started again. The water losses occurring in the steepers due to evaporation and the ammonium sulfate losses due to discharge are also supplemented. In this electrochemical recovery a current efficiency of 67 % can be maintained, and the specific energy requirement is 6.1 *k*Wh per 1 kg. of deposited cathode iron. The cathode sheets are replaced daily, and the removed, thickened cathode sheet is processed by molding.

Example 2

Electrochemical processing of pickle waste liquor from rod iron plant, combined with the production of iron powder.

Pickling is carried out batchwise, in open steepers at 80°C. The pickle waste liquor contains 80 g. of acid, 80 g. of $Fe^{2+}$ and 90 g. of sodium sulfate per liter. The construction and operation of the electrolysis equipment is the same as described in Example 1. The final catholite contains 12 g. of iron and 174 g. of sodium sulfate per liter. The sulfuric acid content of the final anolite is 199 g./l., its sodium sulfate content is 90 g./l.

The electrolysis equipment consists of 16 unit cells serially connected with each other. The steady-state concentrations in the cathode chamber of cell 11 are as follows: 16 g. of sulfuric acid, 24 g. of $Fe^{2+}$ and 148 g. of sodium sulfate per liter. Iron sheet cathodes are immersed into the first ten cells, they are handled as described in the previous Example. In the other cells soft lead sheets are used as cathode. These lead sheets are removed 2–6 times a day, and passed through a bend roll under slight bending, whereupon the adhered iron powder runs down and can be collected. The cathode must always be removed under maintaining the current. Since more than one cathode operates in one cell, the removal of a cathode sheet does not break the current. The current efficiency is 60 % for block iron and 66 % for iron powder, and the specific energy requirement is 7.0 *k*Wh/kg. for block iron and 6.4 *k*Wh/kg. for iron powder.

What we claim is:

1. A process for the cyclic electrochemical processing of pickle waste liquors containing a maximum of 100 g. of sulfuric acid and a minimum of 25 g. of iron ions per liter, by the electrochemical decomposition of iron sulfate and the electrodialytic separation of the acid and sulfate salt components of the pickle waste liquor, in which the ammonium, magnesium or alkali metal sulfate concentration of the waste liquor is adjusted to 0.5 to 1.0 mol./l. by introducing an ammonium, magnesium or alkali-metal salt, and the acid content of the waste liquor is reduced to a value not exceeding 100 g. of sulfuric acid/liter, then the waste liquor is fed into and passed as catholyte through the cathode chambers of a series of dual electrolytic cells with diaphragms, whereupon the iron content of the waste liquor is reduced to a value of 7 to 15 g. of $Fe^{2+}$/-liter, thereafter the waste liquor is fed into and passed as anolyte through the anode chambers of said electrolytic cells in parallel with the cathode flow, and a current density of 15 to 22 A/dm². of diaphragm surface and an electrolysis temperature of 70 to 90°C is maintained in said cells.

2. A process as defined in claim 1, in which the volume rate of flow of the solution passing the cycle is maintained at a level directly proportional to the current efficiency, the number of the electrolyzing cells and the current intensity, and inversely proportional to the difference in acidity between the solutions leaving and entering the electrolyzing system, and the pH of the solution leaving the last cathode chamber of the system is measured, and when this value is lower than 1.8 the flow rate is decreased, whereas when this value is higher than 1.8 the flow rate is increased.

3. A process as defined in claim 1, in which the iron ions of the pickle waste liquor are deposited onto an iron sheet cathode in said cells, and the thickened cathode sheet is occasionally removed and replaced by a new iron sheet.

4. A process as defined in claim 1, in which a concentration of 0.5 to 1.0 mol./l. of the sodium and/or potassium sulfate additive is maintained during pickling, an aluminum lead or graphite cathode is immersed in the into containing not more than 25 g./l. of $Fe^{2+}$, and the iron powder layer deposited onto the surface of the cathodes is occasionally removed.

* * * * *